US006924468B2

(12) United States Patent
Abbott et al.

(10) Patent No.: US 6,924,468 B2
(45) Date of Patent: Aug. 2, 2005

(54) SYSTEM AND METHOD FOR HEATING MATERIALS

(75) Inventors: Richard C. Abbott, New Boston, NH (US); Gary P. Magnant, Topsfield, MA (US); Samuel L. Winebaum, Rye, NH (US); Richard S. Combs, Farmington, NH (US)

(73) Assignee: ThermoCeramiX, Inc., Shirley, MA (US)

( * ) Notice: Subject to any disclaimer, the term of this patent is extended or adjusted under 35 U.S.C. 154(b) by 0 days.

(21) Appl. No.: 10/453,323

(22) Filed: Jun. 3, 2003

(65) Prior Publication Data

US 2004/0112892 A1 Jun. 17, 2004

Related U.S. Application Data

(60) Provisional application No. 60/433,539, filed on Dec. 14, 2002.

(51) Int. Cl.[7] ..... H05B 3/02

(52) U.S. Cl. ..... 219/546; 219/465.1; 219/444.1; 219/543; 219/219

(58) Field of Search ..... 219/444.1, 465.1, 219/466.1, 543, 544, 545, 546, 549, 219, 216

(56) References Cited

U.S. PATENT DOCUMENTS

| | | | | | |
|---|---|---|---|---|---|
| 3,610,888 | A | * | 10/1971 | Button | 219/543 |
| 3,883,719 | A | * | 5/1975 | Hurko | 219/466.1 |
| 4,039,777 | A | | 8/1977 | Baker | 219/439 |
| 4,300,990 | A | * | 11/1981 | Maurer | 204/412 |
| 5,007,818 | A | * | 4/1991 | Barancik et al. | 425/144 |
| 5,155,340 | A | * | 10/1992 | Morita et al. | 219/543 |
| 5,504,307 | A | * | 4/1996 | Hayashi et al. | 219/543 |
| 5,616,266 | A | | 4/1997 | Cooper | 219/543 |
| 5,869,808 | A | * | 2/1999 | Hyllberg | 219/216 |
| 5,938,957 | A | * | 8/1999 | Tanahashi et al. | 219/219 |
| 5,973,298 | A | * | 10/1999 | Kallgren | 219/465.1 |
| 5,981,913 | A | * | 11/1999 | Kadomura et al. | 219/444.1 |
| 6,037,574 | A | | 3/2000 | Lanham et al. | 219/544 |
| 6,376,816 | B2 | | 4/2002 | Cooper et al. | 219/543 |
| 6,444,957 | B1 | * | 9/2002 | Kitagawa et al. | 219/444.1 |

FOREIGN PATENT DOCUMENTS

| | | | | |
|---|---|---|---|---|
| JP | 354094346 | * | 7/1979 | B41J/3/20 |
| JP | 408069868 | * | 3/1996 | H05B/6/12 |

* cited by examiner

*Primary Examiner*—Robin O. Evans
*Assistant Examiner*—Leonid Fastovsky
(74) *Attorney, Agent, or Firm*—Peter A. Nieves; Hayes Soloway PC

(57) ABSTRACT

A system and method for heating materials is provided. Generally, the system contains a first layer upon which a material may be placed for heating the material, wherein the first layer has sufficient conductivity to allow heat to travel through the first layer. The system also contains a heater layer provided on the first layer, which is capable of providing heat to the first layer for heating the material. In addition, the system has an insulator layer for protecting the heater layer from contaminants.

20 Claims, 6 Drawing Sheets

SYSTEM AND METHOD FOR HEATING MATERIALS

CROSS-REFERENCE TO RELATED APPLICATION

This application claims priority to U.S. Provisional Application entitled, "Resistive Heater For Low Thermal Expansion Materials," having Ser. No. 60/433,539, filed Dec. 14, 2002, now abandoned, which is entirely incorporated herein by reference.

FIELD OF THE INVENTION

The present invention is generally related to heat transfer, and more particularly is related to a system and method for heating materials.

BACKGROUND OF THE INVENTION

Technology utilized for providing heating surfaces has changed dramatically over time. One example of a material utilized for fabrication of heating surfaces is glass ceramics. Glass ceramics are useful for use as heating surfaces since glass ceramics provide a smooth and hard surface that may easily be cleaned, they are chemically stable at cooking and boiling temperatures, and due to glass ceramics typically having a low coefficient of thermal expansion, they are resistant to thermal shock.

Examples of heating systems that utilize glass ceramics include, but are not limited to, cook tops and laboratory hot plates. Typically, these heating systems utilize a large radiant heater as a heat source that is positioned below a surface of a material, such as a nickel chrome resistive element, used as a heating platform.

Unfortunately, use of present glass ceramic heating systems having a heating source positioned there below, is thermally inefficient. Specifically, the nickel-chrome resistive element has a thermal emissivity of approximately sixty percent (60%) or less, while the glass ceramic has a thermal transmittance of approximately eighty percent (80%) or less. In addition, a pot, or other device utilized for heating a substance therein, is required to be engineered in a shape and have surface properties that allow for high thermal absorption.

Attempts have been made to make heat transfer associated with the abovementioned glass ceramic heating system predominantly conductive. As an example, U.S. (U.S.) Pat. No. 4,039,777 (hereafter, "the '777 patent"), issued Aug. 2, 1977, to Fred E. Baker, discloses a heating system fabricated by cementing resistive heating wires to the glass ceramic, positioning wire elements contained within an insulating structure next to the glass ceramic, and configuring sheath type elements so that heat is conducted to the glass ceramic. Unfortunately, the heating system of the '777 patent is not thermally efficient. Specifically, the '777 system utilizes resistive heating wires located within a cement layer. The heating wires are intended to heat the entire cement layer. When the cement layer is heated, the heat is conducted to the glass ceramic. Unfortunately, heat is lost throughout the cement layer, thereby resulting in poor thermal efficiency. In addition, heat is poorly, and unevenly, displaced in the '777 patent system since the portions providing heat are limited to the heating wires, which are spaced apart a predetermined distance.

One example of a heating system is categorized as a thick film heater. U.S. Pat. No. 6,037,574, issued Mar. 14, 2000, to Lanham, et al., discloses an example of a thick film heater, which contains noble metals in a glass paste deposited on quartz, wherein, as is known by those having ordinary skill in the art, quartz is a low thermal expansion glass, or glass ceramic. In addition, Watlow Electric Manufacturing Company of St. Louis, Mo. manufactures thick film heaters. Unfortunately, thick film heaters suffer from performance problems due to a lack of molecular bonding of the paste to the glass ceramic. The lack of molecular bonding may result in poor thermal conductivity. Specifically, the coefficient of thermal expansion of the noble metal paste does not match the coefficient of thermal expansion of the glass ceramic, thereby resulting in cracking between the paste and the glass ceramic after repetitive heating and cooling of the thick film heater.

Another example of a heating system is categorized as a thin film heater. U.S. Pat. Nos. 5,616,266, issued Apr. 1, 1997, to Richard Cooper, and 6,376,816, issued Apr. 23, 2002, to Cooper, et al., disclose examples of thin film heaters. In addition, Thermo-Stone USA, LLC, of Marina, Calif. manufactures radiant thin film heaters. Unfortunately, thin film heaters do not deliver adequate power to provide for efficient use in cook top applications. Specifically, sputtering, evaporating, chemical vapor deposition (CVD), or other techniques of providing a thin film heater are inadequate because the resulting thin film heater does not provide adequate conductance properties to allow normal and high voltages, and associated currents, to be accommodated for by the resulting thin film heater.

Thus, a heretofore unaddressed need exists in the industry to address the aforementioned deficiencies and inadequacies.

SUMMARY OF THE INVENTION

Embodiments of the present invention provide a system and method for heating materials. Briefly described, in architecture, one embodiment of the system, among others, can be implemented as follows. The system contains a first layer upon which a material may be placed for heating the material, wherein the first layer has sufficient conductivity to allow heat to travel through the first layer. The system also contains a heater layer provided on the first layer, which is capable of providing heat to the first layer for heating the material. In addition, the system has an insulator layer for protecting the heater layer from contaminants.

The present invention can also be viewed as providing methods for providing a heating system. In this regard, one embodiment of such a method, among others, can be broadly summarized by the following steps: thermally spraying a heater layer on a first layer, wherein the first layer is capable of supporting a material to be heated; and fabricating an insulator layer on the heater layer, wherein the insulator layer protects the heater layer from contaminants.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The present invention provides a heating system and method that is capable of heating materials. For exemplary purposes, the present description is provided with reference to a cook top that is efficiently heated by thermal conduction, however, it should be noted that that the invention may be utilized on a wide variety of apparatus for the heating of materials with low thermal expansion. For exemplary purposes, the following describes the materials to be heated as low thermal expansion materials. It should be noted, however, that the present invention may be utilized to heat different thermal expansion materials, such as high thermal expansion materials. Examples of these apparatus include, but are not limited to, cook tops, cooking pots and containers, laboratory heaters, tubes, water heaters, semiconductor processing equipment, chemical processing systems, and medical devices.

In addition, the heating system avoids problems associated with thin film heaters and thick film heaters, due to deposition of at least one resistive layer via use of thermal spraying methods. An example of thermal spraying is described in U.S. patent application entitled, "Resistive Heaters and Uses Thereof," by Abbott, et al., filed on Nov. 28, 2001, and having Ser. No. 09/996,183 (hereafter, "the '183 patent"), the disclosure of which is hereby incorporated by reference in its entirety. It should be noted that the '183 patent describes methods of depositing materials capable of generating high power, where the deposited materials bond by chemical action to a different material, such as, but not limited to, glass ceramic.

Figure 1:
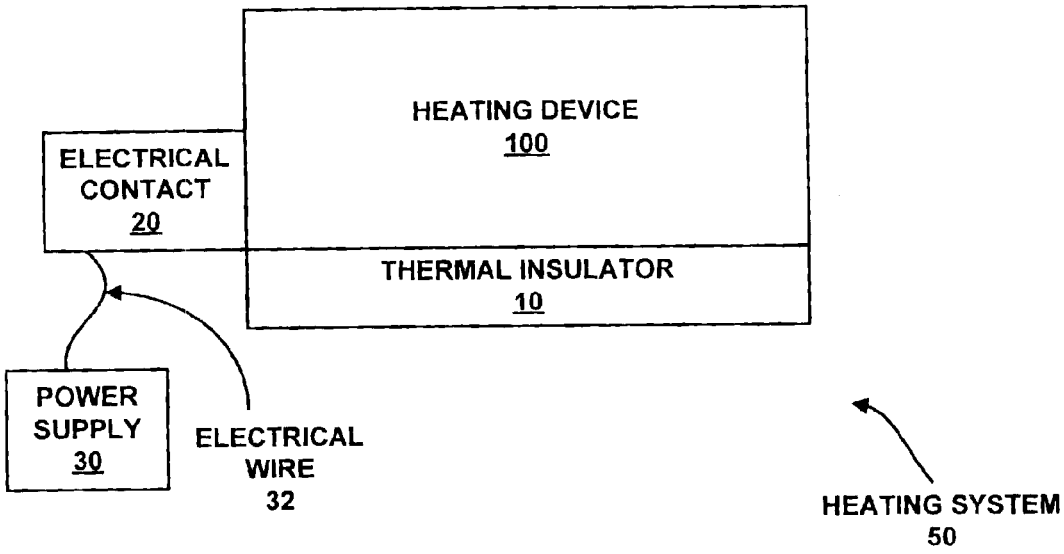
FIG. 1 is a schematic diagram illustrating a heating system in accordance with a first exemplary embodiment of the invention.

FIG. 1 is a schematic diagram illustrating the heating system 50 in accordance with a first exemplary embodiment of the invention. As is shown by FIG. 1, the heating system 50 contains a thermal insulator 10, an electrical contact 20, a power supply 30, and a heating device 100. The heating device 100 is described in detail below with reference to FIG. 2–FIG. 5. In addition, the electrical contact 20 is described in detail below with reference to FIG. 6.

The thermal insulator 10, which is preferably located below the heating device 100, thermally insulates the heating device 100. Specifically, the thermal insulator 10 may reduce conduction, reduce radiation, or both reduce conduction and reduce radiation, as long as the thermal insulator 10 is capable of thermally insulating the heating device 100.

If the thermal insulator 10 reduces conduction, material utilized to provide the thermal insulator 10 may be selected from, for example, but not limited to, porous aluminum oxide or silica. In fact, a wide variety of commercial insulators having properties similar to porous aluminum oxide and silica may be selected. Specifically, the thermal insulator 10 may be provided by materials having low thermal conductivity.

Alternatively, if the thermal insulator 10 reduces radiation, material utilized to provide the thermal insulator 10 may be selected from different material having a very high reflectivity, such as, but not limited to, a metallic sheet and a metallic coating located on a glass substrate. Specifically, the thermal insulator 10 may be provided by materials having low thermal emissivity.

The power supply 30 may be a conventional power supply that is capable of providing a charge that is capable of powering the heating device 100. Specifically, a conventional power supply may provide a voltage of 110 volts (V) or 220 volts (V), such as a power supply located within a home that provides a charge to be channeled via a wall outlet connection. It should be noted, however, that a remote power supply can instead be utilized. In addition, a power supply that provides more than 220 volts, or less than 110 volts may be utilized.

Figure 2:
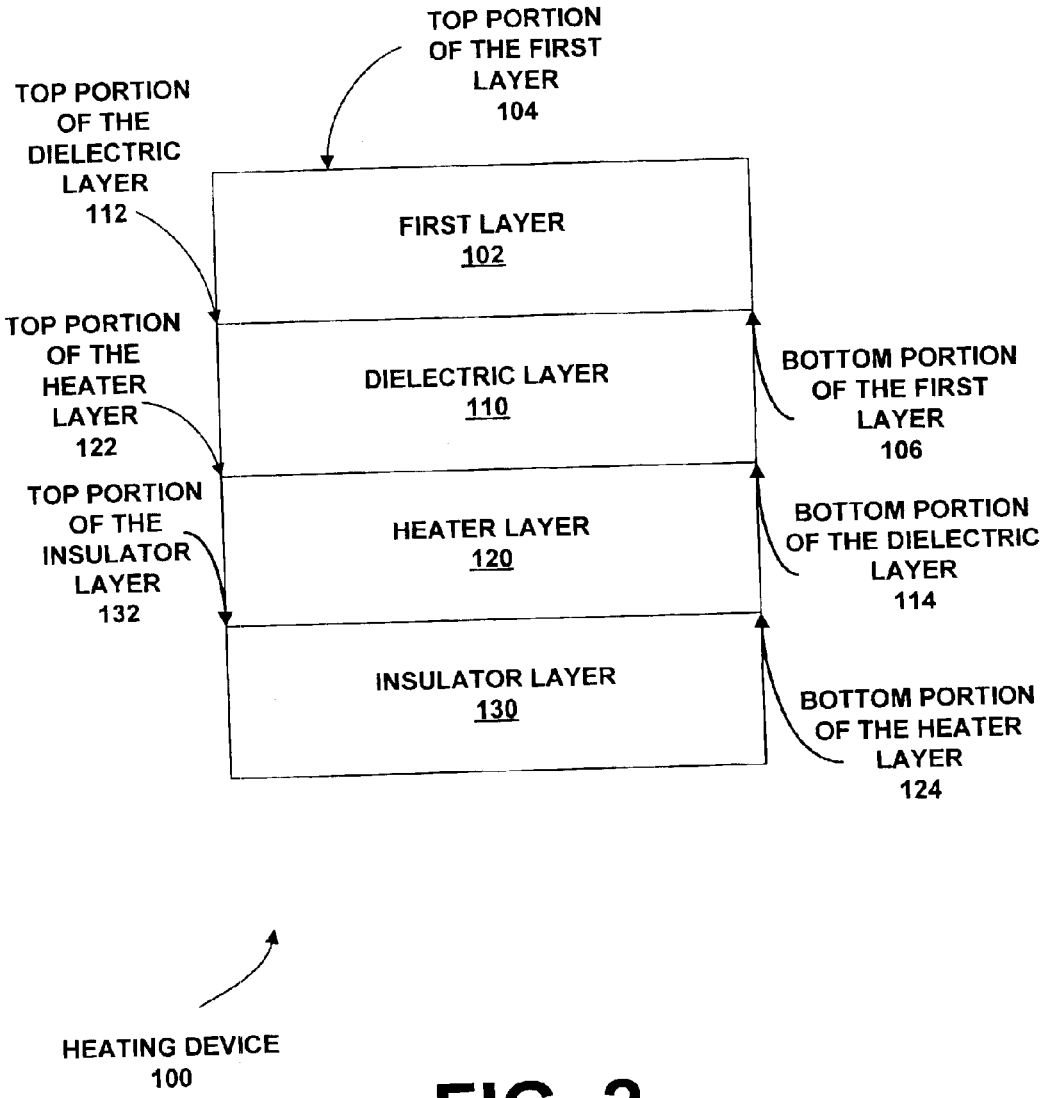
FIG. 2 is a schematic diagram illustrating a cross-sectional view of a heating device located within the heating system of FIG. 1.

FIG. 2 is a schematic diagram illustrating a cross-sectional view of the heating device 100 of FIG. 1, in accordance with the first exemplary embodiment of the invention. As is shown by FIG. 2, the heating device 100 contains a first layer 102. In accordance with the first exemplary embodiment of the invention, the first layer 102 has properties that allow the first layer 102 to have sufficient mechanical strength to withstand pressure, impact, and/or properties of a device or product placed intentionally or accidentally on the first layer 102. Specifically, thickness of the first layer 102 is large enough to provide sufficient mechanical strength, yet is as small as possible to minimize reduction of an amount of heat that conducts to a top portion 104 of the first layer 102. In other words, the first layer 102 is preferably as thick as is possible without reducing conductance properties of the first layer 102.

Another variable that may be considered in determining thickness of the first layer 102 may be horizontal conductance of heat. Specifically, it is preferred that heat conduct to the top portion 102 of the first layer 102, and not more than a minimal horizontal distance. By minimizing horizontal conductance, heating of the top portion 102 is restricted to a specific pre-defined portion of the top portion 102.

For exemplary purposes, the first layer 102 may measure approximately 4 millimeters (mm) to 5 mm in thickness and have a coefficient of thermal expansion of less than 4×10E-6/° C. It should be noted however, that the first layer 102 may have a different thickness and have a different coefficient of thermal expansion. As is known by those having ordinary skill in the art, the coefficient of thermal expansion is the fractional increase in length per unit rise in temperature. Although other materials may be utilized, due to characteristics such as having a smooth and hard surface that may easily be cleaned, being chemically stable at cooking and boiling temperatures, and typically having a low coefficient of thermal expansion, the first layer 102 is preferably fabricated of a glass ceramic or other materials having similar characteristics. In addition, the first layer 102 may be fabricated of a material utilized for countertops such as, but not limited to, Corian®, by DuPont®, granite, or other materials if made thermally conductive.

The top portion 104 of the first layer 102 may be utilized as a heating surface. In addition, the first layer 102 also contains a bottom portion 106. In accordance with the first exemplary embodiment of the invention, the bottom portion 106 of the first layer 102 is a substrate, upon which a dielectric layer 110 is located. Specifically, a top portion 112 of the dielectric layer 110 is located on the bottom portion 106 of the first layer 102. A heater layer 120 is located on a bottom portion 114 of the dielectric layer 110. Specifically, a top portion 122 of the heater layer 120 is located on the bottom portion 114 of the dielectric layer 110. For exemplary purposes, the dielectric layer 110 may measure approximately 0.05 mm to 2.0 mm in thickness. It should be noted however, that the dielectric layer 110 may have a different thickness.

The dielectric layer 110 is capable of reducing thermoelastic stresses in the heater layer 120. Preferably, the dielectric layer 110 has a coefficient of thermal expansion that is between a coefficient of thermal expansion of the first layer 102 and a coefficient of thermal expansion of the heater layer 120. Therefore, the coefficient of thermal expansion of the dielectric layer 110 is lower than the coefficient of thermal expansion of the heater layer 120. It should be noted, however, that the coefficient of thermal expansion of the dielectric layer 110 need not be between the coefficient of thermal expansion of the first layer 102 and the coefficient of thermal expansion of the heater layer 120.

In accordance with a second embodiment of the invention, the heating device 100 does not have a dielectric layer 110. Specifically, inclusion of the dielectric layer 110 may depend upon bulk resistivity of the first layer 102 and appropriate regulations pertaining to minimum dielectric strength between an electrically energized heating element and a conducting device, such as a metallic cooking pot, resting on the top portion 104 of the first layer 102. As an example, certain countries have regulations (e.g., Underwritters Laboratories, Inc. (UL) Standards) on a maximum leakage current allowed between the top portion 104 of the first layer 102 and a heating element. In these countries the dielectric layer 110 may be useful since dielectrics dissipate a minimum amount of energy, while supporting an electrostatic field.

Figure 3A:
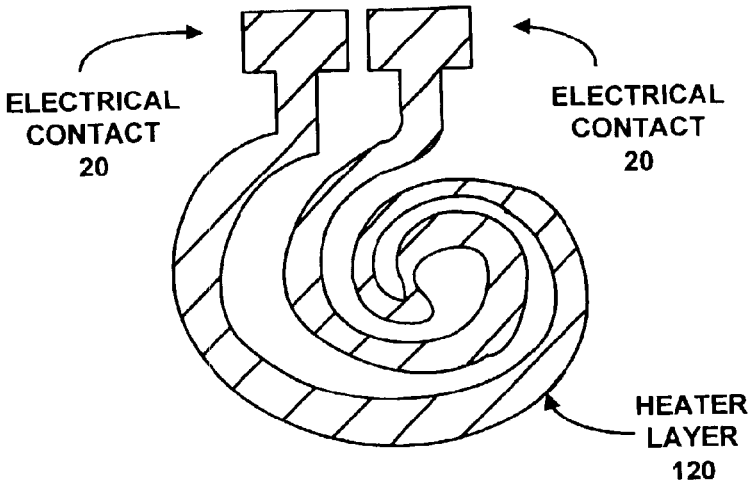
FIG. 3A is a schematic diagram illustrating the heater layer of FIG. 2 in a ring coil configuration.
Figure 3B:
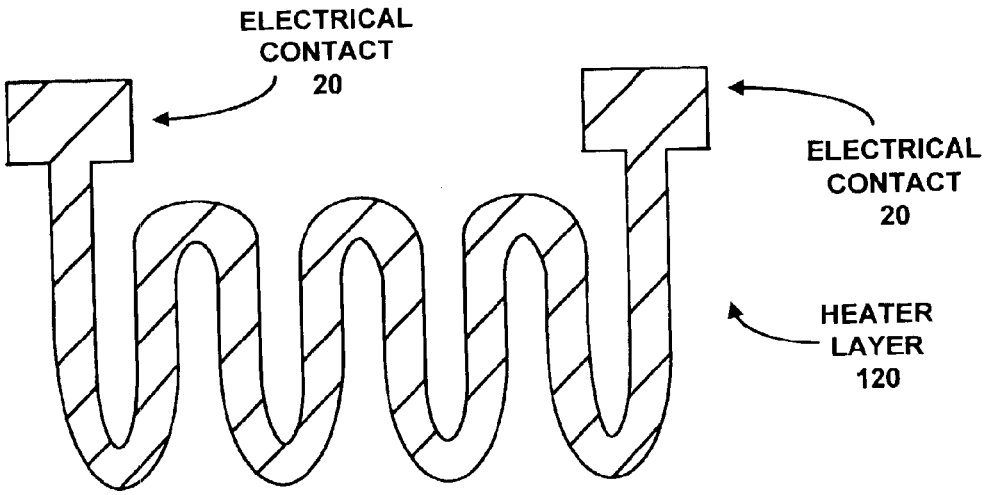
FIG. 3B is a schematic diagram illustrating the heater layer of FIG. 2 in an elongated configuration.

FIG. 3A and FIG. 3B are schematic diagrams illustrating examples of the heater layer 120 of FIG. 2. It should be noted that the heater layer 120 may have different shapes and sizes. As an example, FIG. 3A illustrates the heater layer 120 in a ring coil configuration. Electrical contacts 20 are also illustrated by FIG. 3A. Alternatively, FIG. 3B illustrates the heater layer 120 in an elongated configuration for covering additional surface area. Electrical contacts 20 are also illustrated by FIG. 3B. For exemplary purposes, the heater layer 120 may measure approximately 0.05 mm to 1.0 mm in thickness. It should be noted however, that the heater layer 120 may have a different thickness.

Returning to FIG. 2, an insulator layer 130 is located on a bottom portion 124 of the heater layer 120. Specifically, a top portion 132 of the insulator layer 130 is located on the bottom portion 124 of the heater layer 120. The insulator layer 130 protects the heater layer 120 from contaminants such as, but not limited to, acidic vapors and/or humidity derived from a substance being heated by the heating system 50, or possible oxidation or nitridation. For exemplary purposes, the insulator layer 130 may measure approximately 0.05 mm to 2.0 mm in thickness. It should be noted however, that the insulator layer 130 may have a different thickness.

Preferably, the coefficient of thermal expansion of the insulator layer 130 is lower, specifically, preferably slightly lower, than the coefficient of thermal expansion of the heater layer 120. If the coefficient of thermal expansion of the insulator layer 130 is lower than that of the heater layer 120, and the coefficient of thermal expansion of the dielectric layer 110 is lower than that of the heater layer 120, upon heating, the top portion 122 of the heater layer 120 is compressed, thereby preventing cracking of the heater layer 120 and ensuring proper thermal emission from the heater layer 120 to the first layer 102. It should be noted, however, that the coefficient of thermal expansion of the insulator layer 130 need not be lower than the coefficient of thermal expansion of the heater layer 120.

It should be noted that the insulator layer 130 preferably has low thermal conductivity, thereby providing a thermally insulating barrier. In addition, the insulator layer 130 preferably has low thermal emissivity to prevent the loss of heat. Still further, due to the above-mentioned properties, the insulator layer 130 may also serve as an electrical insulator to prevent exposure of the heater layer 120 to elements that may be flammable or provide a different hazardous situation.

Figure 4:
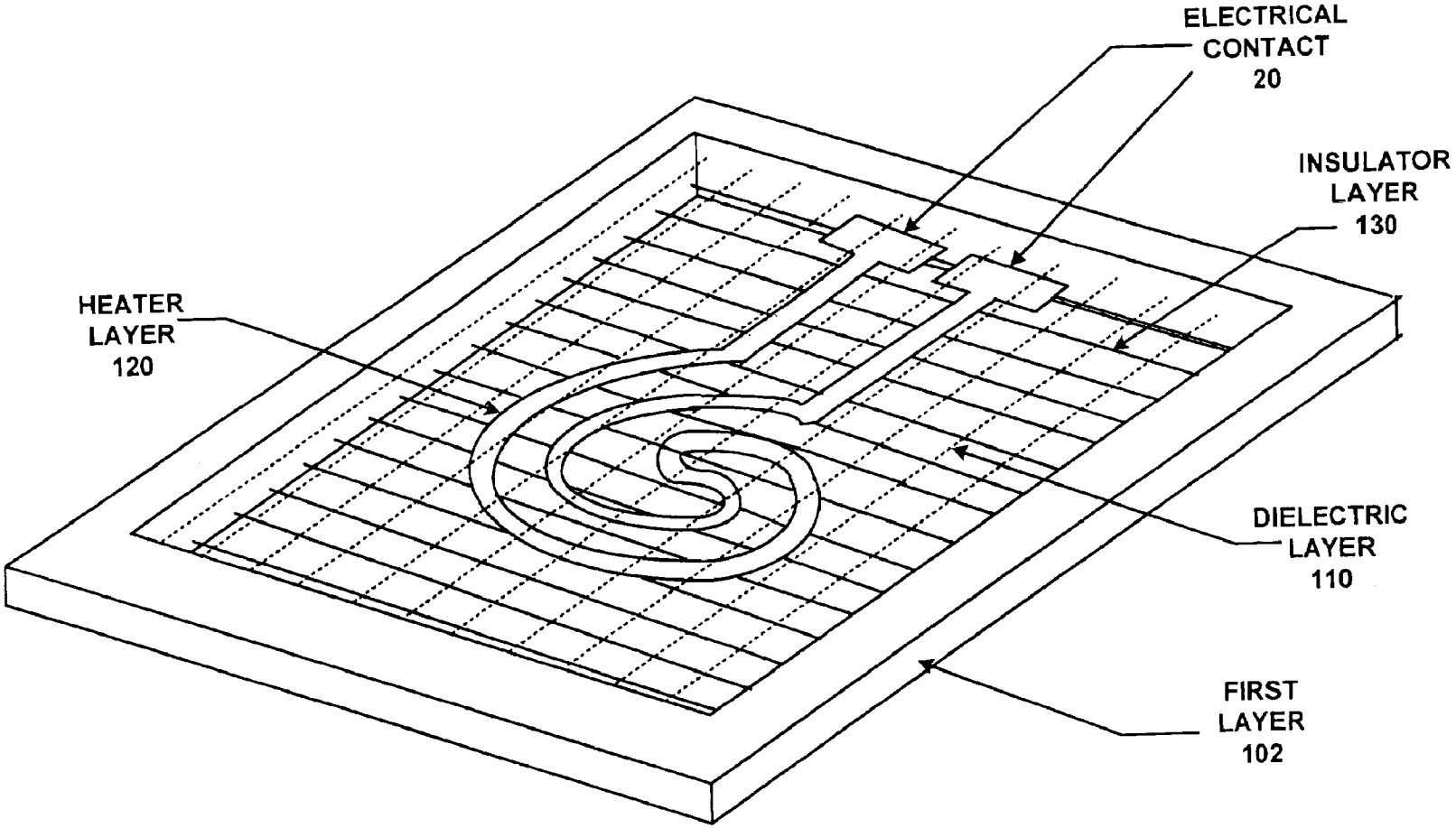
FIG. 4 is a schematic diagram providing an example of location of the heating device.

For exemplary purposes, FIG. 4 is a schematic diagram providing one example of location of the heating device 100. Specifically, FIG. 4 shows location of the first layer 102, the dielectric layer 110, the heater layer 120, and the insulator layer 130. As is shown by FIG. 4, the heater layer 120 is protected by both the dielectric layer 100 and the insulator layer 130. Alternatively, if the heating device 100 does not have a dielectric layer 110, the heater layer 120 is protected by the first layer 102 and the insulator layer 130.

Figure 5:
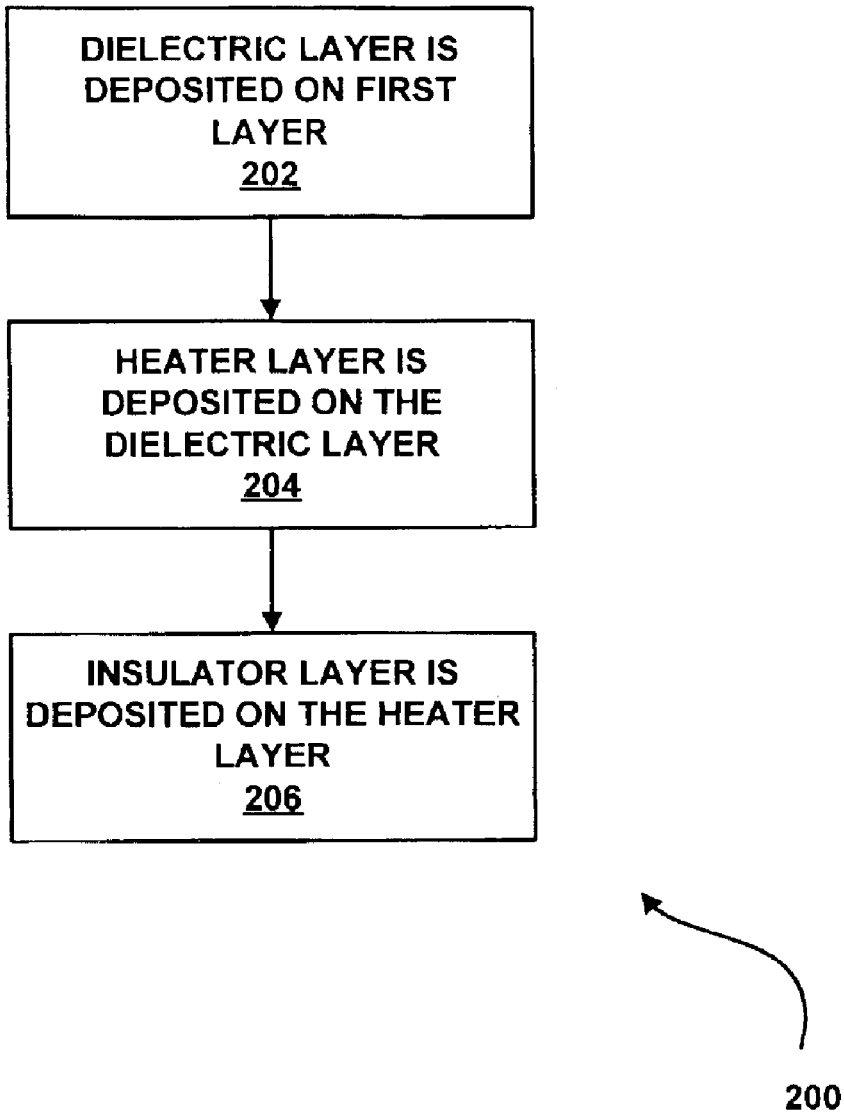
FIG. 5 is a flowchart illustrating a method of providing the heating device of FIG. 2.

FIG. 5 is a flowchart 200 illustrating a method of providing the abovementioned heating device 100 in accordance with the first exemplary embodiment of the invention. It should be noted that any process descriptions or blocks in flow charts should be understood as representing modules, segments, portions of code, or steps that include one or more instructions for implementing specific logical functions in the process, and alternate implementations are included within the scope of the present invention in which functions may be executed out of order from that shown or discussed, including substantially concurrently or in reverse order, depending on the functionality involved, as would be understood by those reasonably skilled in the art of the present invention.

As is shown by block 202, the dielectric layer 110 is deposited on the first layer 102. It should be noted that the dielectric layer 110 may be deposited as an uninterrupted area over the first layer 102 or in a pattern that is similar to a pattern utilized for the heater layer 120.

The dielectric layer 110 may be deposited via different methods, such as, but not limited to, thermal spraying, sputtering, evaporation, or thick film techniques such as screen printing or flowing of dielectric material as a paste, with subsequent heat treatment. Composition of the dielectric layer 110 preferably provides dielectric strength at operating temperatures of the heating device 100, a coefficient of thermal expansion that is similar to the coefficient of thermal expansion associated with the first layer 102, and allows for the dielectric layer 110 to chemically bond with the first layer 102.

As an example, the dielectric layer 110 may be fabricated from a combination of crushed and milled glass ceramic having a similar composition to the first layer 102, blended with approximately ninety-six percent (96%) purity fused silica in volumetric proportions that account for thermal expansion coefficients (resulting in a material having a coefficient of thermal expansion that is an average of a coefficient of thermal expansion of the glass ceramic and a coefficient of thermal expansion of the silica), bulk resistivities, and elastic moduli of the dielectric layer 110. Alternatively, the dielectric layer 110 may be a thermally sprayed blend of eucryptite and cordierite. Specifically, materials utilized to fabricate the dielectric layer 110 preferably are characterized by a low coefficient of thermal expansion and a high dielectric strength. It should be noted, however, that material utilized to fabricate the dielectric layer 110 may instead have a higher coefficient of thermal expansion and/or a lower dielectric strength.

As is shown by block 204, the heater layer 120 is deposited on the dielectric layer 110. An example of a method that may be used to fabricate the heater layer 120 is provided by the '183 patent, which has been incorporated by reference in its entirety. Specifically, as an example, a thermal spray gun and a gas source may be utilized where the gas source includes two or more gases that can be mixed in an arbitrary combination.

Electrical resistivity of the heater layer 120 is preferably 1×10E-4 to 0.1 ohm-cm. A desired electrical resistivity of the heater layer 120 may be formulated via use of an electrically conductive ceramic that is blended with several electrically insulating ceramics, such that an average threshold conduction level is reached by interconnecting conductive particles. The desired electrical resistivity of the heater layer 120 is then formulated by taking into account power and voltage requirements of the heating device 100, the nature of an electrical circuit providing power to the heating device 100 (i.e., parallel and series components), the geometric properties of current path length, and the cross-sectional area through which current passes within the heater layer 120, wherein the cross-sectional area comprises the thickness and width of the heater layer 120.

In order to minimize residual tensile stress in the heater layer 120, which may arise from the thermal spraying process, and in order to minimize compressive stress in the heater layer 120, which may arise during use of the heating device 100, thermal expansion of the heater layer 120 is preferably tailored to match thermal expansion of the material to which the heater layer 120 is bonded. Specifically, thermal expansion of the heater layer 120 is tailored to match thermal expansion of the dielectric layer 110. Tailoring of thermal expansion of the heater layer 120 may be accomplished by blending the electrically conductive ceramic component, which typically has a higher thermal expansion than the first layer 102, with insulative components, which have a thermal expansion coefficient and elastic modulus that will lower the overall thermal expansion of the heater layer 120.

Thermoelastic stress, attributed to thermal expansion, can be further reduced by ensuring that the heater layer 120 operates at the lowest possible temperature for a given power level, thereby minimizing excessive thermal expansion. For example, in looking at a heat equation for conduction, shown below as equation 1 (Eq. 1), wherein Q is heat flux, A is cross sectional area of the heater layer 120 located on the first layer 102, K is thermal conductance, $$\frac{\Delta T}{\Delta x}$$

is the thermal gradient with x as the unit vector normal to the surface across which the heat flux is being measured, wherein ΔT is change in temperature as represented by the coefficient of thermal expansion, it is desirable to have minimal thermal expansion of the heater layer 120, as represented by a low coefficient of thermal expansion. It should be noted, however, that the heater layer 120 needs to be provided with enough power so that the heater layer 120 emits the required Q. Therefore, the larger A is, the smaller ΔT is, which is desirable for the heater layer 120 since, as is mentioned above, minimal thermal expansion of the heater layer 120 is desirable.

$$\frac{Q}{A} = K\frac{\Delta T}{\Delta x} \qquad \text{(Eq. 1)}$$

To minimize thermoelastic stress, and to allow chemical bonding to either the dielectric layer 110 or the first layer 102, the heater layer 120 may contain a zirconium boride electro-conductive ceramic blended with pure silica, for lowering the coefficient of thermal expansion, and pure silicon, for both lowering the coefficient of thermal expansion and providing a reactant with either the dielectric layer 110 or the first layer 102. Other material combinations, such as, but not limited to, molybdenum silicide blended with eucriptite and silicon, or silicon carbide blended with fused silica and mullite, would suffice as a replacement for zirconium boride.

As is shown by block 206, the insulator layer 130 is deposited on the heater layer 120. The insulator layer 130 may be deposited on the heater layer 120 via thermal spraying. As an example, the insulator layer 130 may be thermally sprayed mullite. Alternatively, the insulator layer 130 may be a borosilicate glass deposited by thick film techniques such as, but not limited to, etching or cutting. In addition, the insulator layer 130 may be a ceramic cement, a refractory paint, or an aerogel material. It should be noted that to reduce radiative thermal losses, the material utilized to fabricate the insulator layer 130 may be blended with a metallic component, or the insulator layer 130 may be covered with a reflective metallic component.

Figure 6:
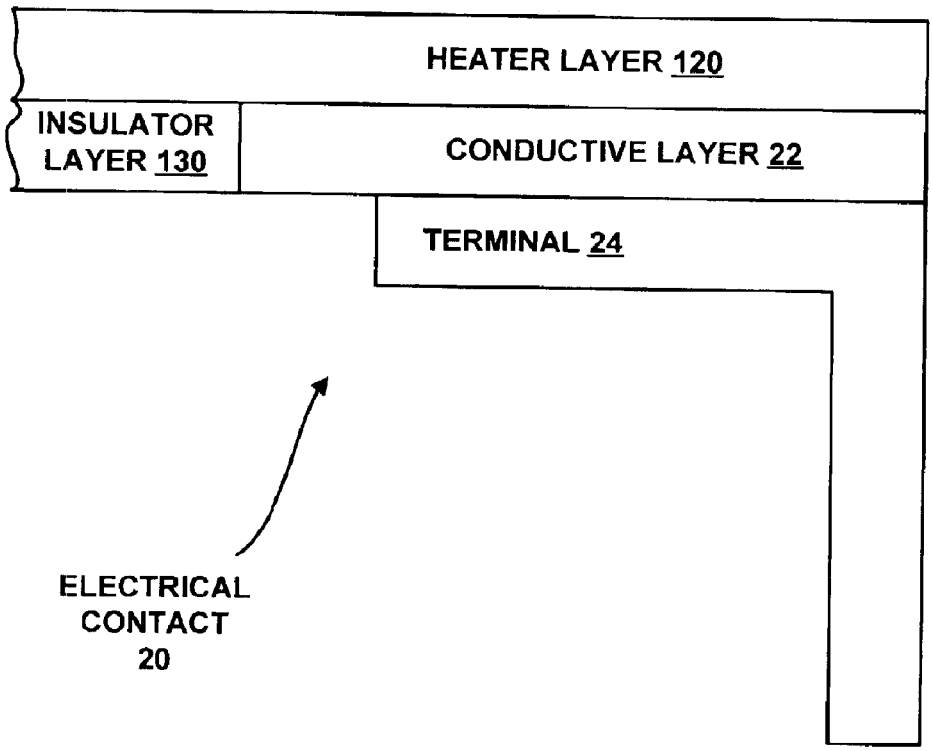
FIG. 6 is a schematic diagram further illustrating the electrical contact located within the heating system of FIG. 1.

FIG. 6 is a schematic diagram further illustrating relationship with the electrical contact 20 of the heating system 50, in accordance with the first exemplary embodiment of the invention. Preferably, although not necessarily, the heater layer 120, which is located within the heating device 100, extends past the heating device 100 onto the electrical contact 20, as is shown by the cross-sectional view provided by FIG. 6. The heater layer 120 extends onto the electrical contact 20 to provide a means for providing electrical energy to the heater layer 120, via the electrical contact 20, which is, in turn, connected to the power supply 30, via an electrical wire 32. The portion of the heater layer 120 that extends onto the electrical contact 20 is designed so that the portion dissipates very low power in the region of the electrical contact 20, and instead, dissipates the heat in the heater layer 120. As an example, width of the electrical contact 20, or contacts, as shown by FIG. 4, is made large, while thickness is small, so that resistivity of the contacts 20 is small, thereby allowing most heat dissipation to take place in the heater layer 120. It should be noted that the insulator layer 130 is also shown by FIG. 6, although both the heater layer 120 and the insulator layer 130 are not part of the electrical contact 20.

As is shown by FIG. 6, the electrical contact 20 contains a conductive layer 22 that is applied to the heater layer 120. Preferably, the conductive layer 22 is comprised of one or more materials that adhere well to the heater layer 120, do not oxidize or otherwise degrade in ambient conditions, and can serve as a transition material for attaching the electrical wire 32. The conductive layer 22 may be metallic, for example, a thermally sprayed nickel, a gold paint, an electroplated copper or nickel, or a metallic high temperature epoxy, depending on the temperatures in the region of the electrical contact 20.

As is shown by FIG. 6, a terminal 24 may be attached to the conductive layer 22 for transmission of electrical energy derived from the power supply 30. Specifically, the terminal 24 may be connected to the power supply 30 via the electrical wire 32. One having ordinary skill in the art will appreciate that the terminal 24 may be attached to the conductive layer 22 by soldering, brazing, laser welding, electron beam welding, use of a high temperature conductive epoxy, or by a mechanical means. The heater layer 120 is made into a resistive heater by coupling the power supply 30 (FIG. 2) to the heater layer 120, via the terminal 24, and providing a current from the power supply 30, through the electrical wire 32, terminal 24, and conductive layer 22, to the portion of the heater layer 120 located within the electrical contact 20. Application of the current, through the heater layer 120, causes the heater layer 120 to generate heat, while the electrical contact 20 provides minimal resistance.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A system for heating material, comprising:

a first layer upon which said material may be placed for heating said material, wherein said first layer has sufficient conductivity to allow heat to travel through said first layer;

a heater layer chemically and molecularly bonded to said first layer, which is capable of providing heat to said first layer for heating said material, said heater layer having a coefficient of thermal expansion that is larger than a coefficient of thermal expansion of said first layer; and an insulator layer chemically and molecularly bonded to said heater layer for protecting said heater layer from contaminants, wherein said insulator layer has a coefficient of thermal expansion that is lower than a coefficient of thermal expansion of said heater layer, wherein said coefficient of thermal expansion of said neater layer, in comparison to said coefficient of thermal expansion of said first layer and said coefficient of thermal expansion of said insulator layer results in said heater layer being compressed within said first layer and said insulator layer when said heater layer is heated.

2. The system of claim 1, wherein said first layer has a coefficient of thermal expansion of less than 4×10E-6/° C.

3. The system of claim 1, wherein said first layer has a thickness in the range of approximately 4 millimeters to 5 millimeters in thickness.

4. The system of claim 1, further comprising a dielectric layer that is chemically and molecularly bonded to said first layer and said heater layer, wherein said dielectric layer is capable of reducing thermoelastic stresses in said heater layer, wherein a coefficient of thermal expansion of said dielectric layer is larger than a coefficient of thermal expansion of said first layer and smaller than a coefficient of thermal expansion of said heater layer.

5. The system of claim 1, wherein said heater layer is fabricated via thermal spraying.

6. The system of claim 1, further comprising a thermal insulator having low conductivity, wherein said thermal insulator is located below said insulator layer, and wherein said thermal insulator thermally insulates said first layer, said heater layer, and said insulator layer.

7. The system of claim 1, further comprising at least one electrical contact for allowing power to travel from a power supply to said system, wherein said electrical contact is in connection with said heater layer.

8. The system for claim 1, wherein said heater layer comprises zirconium boride.

9. The system of claim 1, wherein said insulator layer comprises a borosilicate glass.

10. The system of claim 1, wherein said heater layer contains the same surface area as said first layer.

11. The system of claim 1, wherein said heater layer is thermally resistive.

12. A system for heating material, comprising:

means for supporting said material, wherein said means for supporting said material has sufficient conductivity to allow heat to travel through said means for supporting said material;

means for heating said means for supporting, which is chemically and molecularly bonded to said means for supporting, said means for heating having a coefficient of thermal expansion that is larger than a coefficient of thermal expansion of said means for supporting, said means for heating also being thermally resistive; and means for protecting said means for heating from contaminants encountered during heating of said material, said means for protecting being chemically and molecularly bonded to said means for heating and having a coefficient of thermal expansion that is lower than a coefficient of thermal expansion of said means for heating, wherein said coefficient of thermal expansion of said means for heating, in comparison to said means for supporting and said coefficient of thermal expansion of said means for protecting, results in said means for heating being compressed within said means for supporting and said means for protecting when said means for heating is heated.

13. The system of claim 12, wherein said means for heating is fabricated via thermal spraying.

14. The system of claim 12, further comprising means for reducing thermoelastic stresses in said means for heating, wherein said means for reducing thermoelastic stresses in said means for heating is chemically and molecularly bonded to said means for heating and said means for supporting said material, and wherein a coefficient of thermal expansion of said means for reducing thermoelastic stresses is larger than a coefficient of thermal expansion of said means for supporting and smaller than a coefficient of thermal expansion of said means for heating.

15. The system of claim 12, further comprising means for allowing power to travel from a power supply to said system, wherein said means for allowing power to travel is in connection with said means for heating.

16. The system of claim 12, wherein said means for heating contains the same surface area as said means for supporting.

17. A method of providing a heating system, comprising the steps of:

thermally spraying a heater layer on a first layer, wherein said heater layer is capable of providing heat with introduction of power to said heater layer, wherein said first layer is capable of supporting a material to be heated, and wherein said step of thermally spraying said heater layer on said first layer results in said heater layer, being chemically and molecularly bonded to said first layer; and fabricating an insulator layer on said heater layer, resulting in said insulator layer being chemically and molecularly bonded to said heater layer, wherein said insulator layer protects said heater layer from contaminants, wherein said insulator layer has a coefficient of thermal expansion that is lower than a coefficient of thermal expansion of said heater layer, wherein said coefficient of thermal expansion of said heater layer, in comparison to a coefficient of thermal expansion of said first layer and said coefficient of thermal expansion of said insulator layer, results in said heater layer being compressed within said first layer and said insulator layer when said heater layer is heated.

18. The method of claim 17, further comprising the step of chemically and molecularly bonding a dielectric layer to said first layer, wherein said dielectric layer is capable of reducing thermoelastic stresses in said heater layer, wherein a coefficient of thermal expansion of said dielectric layer is larger than said coefficient of thermal expansion of said first layer and smaller than said coefficient of thermal expansion of said heater layer.

19. The method of claim 17, fabricating at least one contact on said heater layer, wherein said at least one contact is capable of providing a charge from a power supply to said heater layer.

20. A system for heating material, comprising:

a first layer upon which said material may be placed for heating said material, wherein said first layer has sufficient conductivity to allow heat to travel through said first layer;

a heater layer chemically and molecularly bonded to said first layer, said heater layer being capable of providing heat to said first layer for heating said material; and an insulator layer for protecting said heater layer from contaminants, wherein said insulator layer is chemically and molecularly bonded to said heater layer, and wherein said insulator layer has a coefficient of thermal expansion that is lower than a coefficient of thermal expansion of said heater layer, wherein said coefficient of thermal expansion of said heater layer, in comparison to said coefficient of thermal expansion of said first layer and said coefficient of thermal expansion of said insulator layer, results in said heater layer being compressed within said first layer and said insulator layer when said heater layer is heated.

* * * * *